US006962168B2

(12) United States Patent
McDaniel et al.

(10) Patent No.: US 6,962,168 B2
(45) Date of Patent: Nov. 8, 2005

(54) CAPACITIVE TOUCH ON/OFF CONTROL FOR AN AUTOMATIC RESIDENTIAL FAUCET

(75) Inventors: Jason A. McDaniel, Batavia, OH (US); Patrick Jonte, Zionsville, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 0 days.

(21) Appl. No.: 10/757,316

(22) Filed: Jan. 14, 2004

(65) Prior Publication Data

US 2005/0150557 A1 Jul. 14, 2005

(51) Int. Cl.[7] ..... F16K 31/02; G05D 7/06

(52) U.S. Cl. ..... 137/624.12; 137/624.11; 137/801; 251/129.04; 4/623

(58) Field of Search ..... 137/614.12, 624.11, 137/801; 251/129.04; 4/623

(56) References Cited

U.S. PATENT DOCUMENTS

| | | | | |
|---|---|---|---|---|
| 5,566,702 A | | 10/1996 | Philipp | |
| 5,694,653 A | * | 12/1997 | Harald | 4/623 |
| 5,730,165 A | | 3/1998 | Philipp | |
| 5,893,387 A | * | 4/1999 | Paterson et al. | 251/129.04 |
| 6,619,320 B2 | * | 9/2003 | Parsons | 137/624.11 |

OTHER PUBLICATIONS

TOTO Products, "Commercial Faucets", 2 pages.
ZURN Plumbing Products Group, 07Aquasense Sensor Operated Faucets, 2 pages.
SLOAN, Optima i.q. Faucet, 1 page.
Symmons, "Ultra-Sense S-6080", 1 page.
Technical Concepts, AutoFaucet® with "Surround Sensor" Technology, 2 pages.

* cited by examiner

*Primary Examiner*—Kevin Lee
(74) *Attorney, Agent, or Firm*—Woodard, Emhardt, Moriarty, McNett & Henry LLP

(57) ABSTRACT

A capacitive touch-controlled automatic faucet comprises: a spout, a magnetically latching valve, a proximity sensor, a handle, a capacitive touch-control, and a logical control. The proximity sensor is sensitive to motion of objects within a detection zone of the proximity sensor. The handle determines a water flow rate and temperature. The capacitive touch-control is positioned in the spout and generates an output signal while the touch-control is in contact with a user. The logical control receives the output signal, and toggles the magnetically latching valve when the output signal begins and ends within a period of time less than a predetermined threshold, but does not toggle the magnetically latching valve when the output signal persists for a period longer than the predetermined threshold. The faucet has a manual mode, wherein the proximity sensor is inactive, and a hands-free mode, wherein water flow is toggled in response to the proximity sensor.

21 Claims, 2 Drawing Sheets

CAPACITIVE TOUCH ON/OFF CONTROL FOR AN AUTOMATIC RESIDENTIAL FAUCET

BACKGROUND

1. Field of the Invention

The present invention generally relates generally to the field of automatic faucets. More particularly, the present invention relates to a capacitive touch on/off controller for automatic residential faucets.

2. Description of the Related Art

Automatic faucets have become popular for a variety of reasons. They save water, because water can be run only when needed. For example, with a conventional sink faucet, when a user washes their hands the user tends to turn on the water and let it run continuously, rather than turning the water on to wet their hands, turning it off to lather, then turning it back on to rinse. In public bathrooms the ability to shut off the water when the user has departed can both save water and help prevent-vandalism.

One early version of an automatic faucet was simply a spring-controlled faucet, which returned to the "off" position either immediately, or shortly after, the handle was released. The former were unsatisfactory because a user could only wash one hand at a time, while the latter proved to be mechanically unreliable.

One solution was the hands-free faucet. These faucets employed a proximity detector and an electric power source to activate water flow without the need for a handle. In addition to helping to conserve water and prevent vandalism, hands-free faucets had additional advantages, some of which began to make them popular in homes, as well as public bathrooms. For example, there is no need to touch the faucet to activate it; with a conventional faucet, a user with dirty hands may need to wash the faucet after washing their hands. In public facilities non-contact operation is more sanitary. Hands-free faucets also provide superior accessibility for the disabled, the elderly, and those who need assisted care.

Although hands-free faucets have many advantages, some people prefer to directly control the start and stop of water, depending on how they use the faucet. For example, if the user wishes to fill the basin with water to wash something, the hands-free faucet could be frustrating, since it would require the user to keep a hand continuously in the detection zone of the sensors.

Thus, for many applications touch control is preferable to hands-free control. Touch control provides a useful supplement to manual control. Typically, faucets use the same manual handle (or handles) to turn the water flow off and on and to adjust the rate of flow and water temperature. Touch control therefore provides both a way to turn the water off an on with just a tap, as well as a way to do so without having to readjust the rate of flow and water temperature each time.

Consequently, some touch-control faucets have been developed, especially for kitchen sink applications. In some cases, the touch control may be as simple as a push-button. In certain faucets, the touch control is implemented using a strain gauge that responds to the impulse from a tap.

Strain gauges, however, have a number of shortcomings. Because they are sensitive to force, rather than actual contact, their response over the period of a given contact is uneven. For example, when a user first makes contact with a touch sensor based on a strain gauge, the initial impulse of contact appears as a substantially magnified force. After the initial contact, the response of the strain gauge is related to other confounding variables, such as the pressure of the contact, and the direction of the applied force.

Since the purpose of a touch-control is to provide the simplest possible way for a user to activate and deactivate the flow of water, the location of the touch control is an important aspect of its utility. The easier and more accessible the touch control, the more effort is saved with each use, making it more likely that the user will take advantage of it, thereby reducing unnecessary water use. Since the spout of the faucet is closest to the position of the user's hands during most times while the sink is in use, it is an ideal location for the touch control. However, in practice it has proved unsuitable, because the spout of a typical kitchen sink is swiveled between the two basins found in most kitchen sinks. With a touch-control positioned in the spout, when the user touches the spout to swing it from one basin to the other (or to otherwise reposition the spout), the faucet is undesirably deactivated (or activated).

The handle of a faucet is another good location for a touch sensor, because the user naturally makes contact with the handle of the faucet during operation.

Another issue with automatic faucets of all varieties is battery life. For both safety and cost reasons many people prefer to use battery power to operate hands-free faucets. Consequently, power consumption is an important design consideration.

Thus, what is needed is touch-control water faucet that can distinguish between contact for the purpose of activating or deactivating water flow and contact for the purpose of swinging the spout from one basin to the other, and which can be operated on standard commercial batteries without having to change the batteries more than once during a typical three-month period. The present invention is directed towards meeting these needs, among others.

SUMMARY OF THE INVENTION

In a first embodiment, the present invention provides a faucet comprising a spout and a passageway that conducts water flow through the spout. An electrically operable valve is disposed within the passageway; a manual valve is disposed within the passageway in series with the electrically operable valve; and a manual handle controls the manual valve. A capacitive touch control is positioned in the spout, and the capacitive touch control toggles the electrically operable valve.

In a second embodiment, the present invention provides a faucet comprising a spout and a passageway that conducts water flow through the spout. A magnetically latching valve is disposed within the passageway and has an opened position, in which water is free to flow through the passageway, and a closed position, in which the passageway is blocked. A manual valve is disposed within the passageway in series with the electrically operable valve. A manual handle controls the manual valve. A first capacitive touch control is positioned in the spout and generates a first output signal while the touch control is in contact with a user. A second capacitive touch control is positioned in the manual handle and generates a second output signal while the touch control is in contact with a user. A logical control receives the first and second output signals, and toggles the magnetically latching valve when an output signal begins and ends within a period of time between a predetermined lower bound and a predetermined upper threshold. A proximity sensor (270 in FIG. 2) is sensitive to motion of objects within a detection zone of the proximity sensor. The faucet has a manual mode, wherein the proximity sensor is inactive, and a hands-free mode, wherein the magnetically latching valve is toggled between its opened and closed positions in response to the proximity sensor, subject to being over-ridden by the output signal and logical control.

In a third embodiment, the present invention provides a faucet comprising a spout, a touch control disposed within the spout, and a passageway conducting water flow through the spout. An electrically operable valve is disposed within the passageway. A logical control toggles the electrically operable valve when the touch control is touched and released within a period of time less than a predetermined threshold, but does not toggle the electrically operable valve when the touch control is touched for a period longer than the predetermined threshold.

In a fourth embodiment, the present invention provides a capacitive touch control for a faucet having an electrically operable valve that is toggled in response to a toggle signal, the touch control comprising an electrode and a logical control that generates the toggle signal when the touch control is touched and released within a period of time less than a predetermined threshold, but which does not generate a toggle signal when the touch control is touched for a period longer than the predetermined threshold.

BRIEF DESCRIPTION OF THE DRAWINGS

Although the characteristic features of this invention will be particularly pointed out in the claims, the invention itself, and the manner in which it may be made and used, may be better understood by referring to the following descriptions taken in connection with the accompanying figures forming a part hereof.

DETAILED DESCRIPTION OF THE PREFERRED EMBODIMENT

Figure 1:
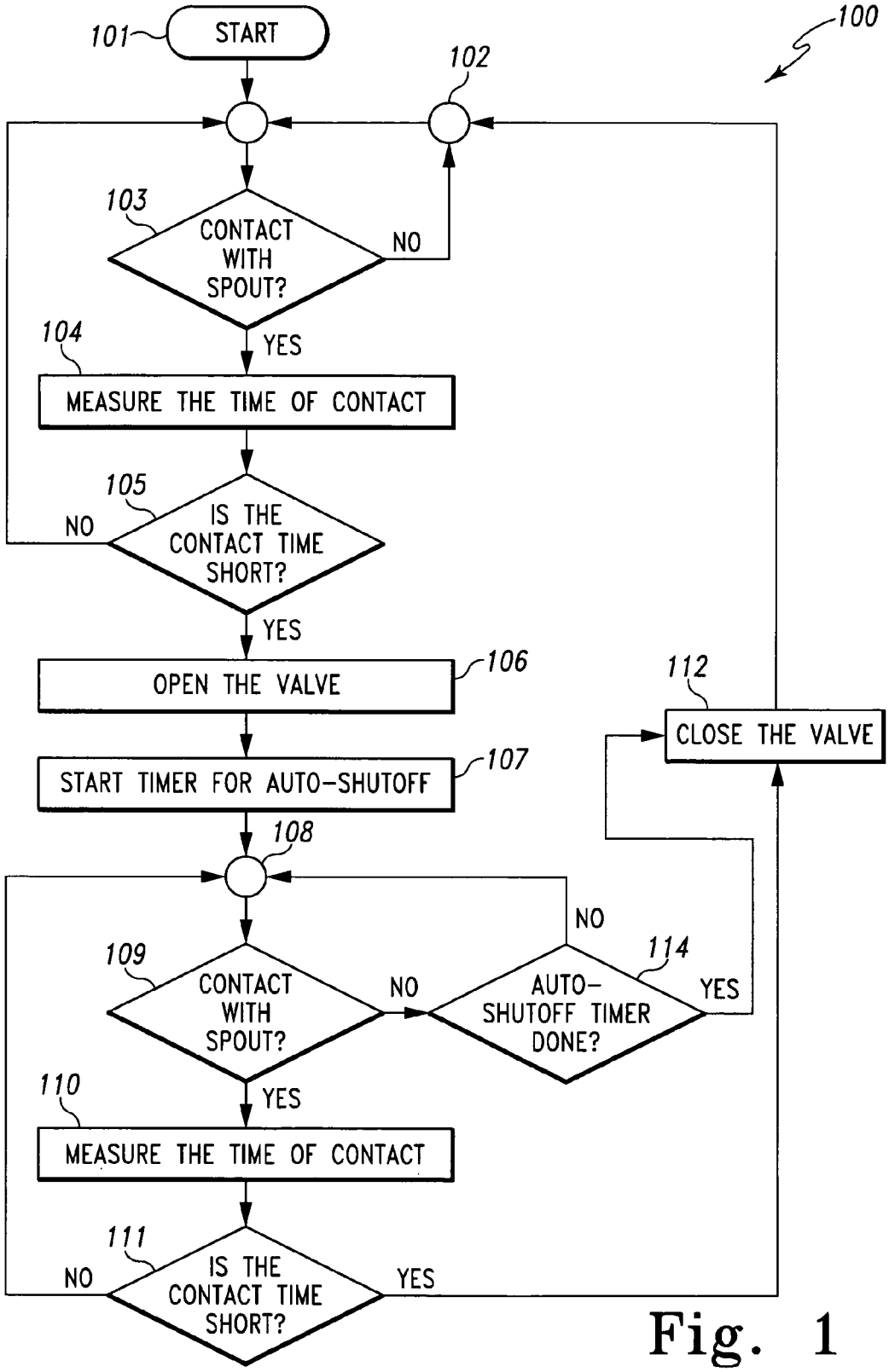
FIG. 1 is a diagram of a logical control for a capactive touch-sensor according to the present invention.
Figure 2:
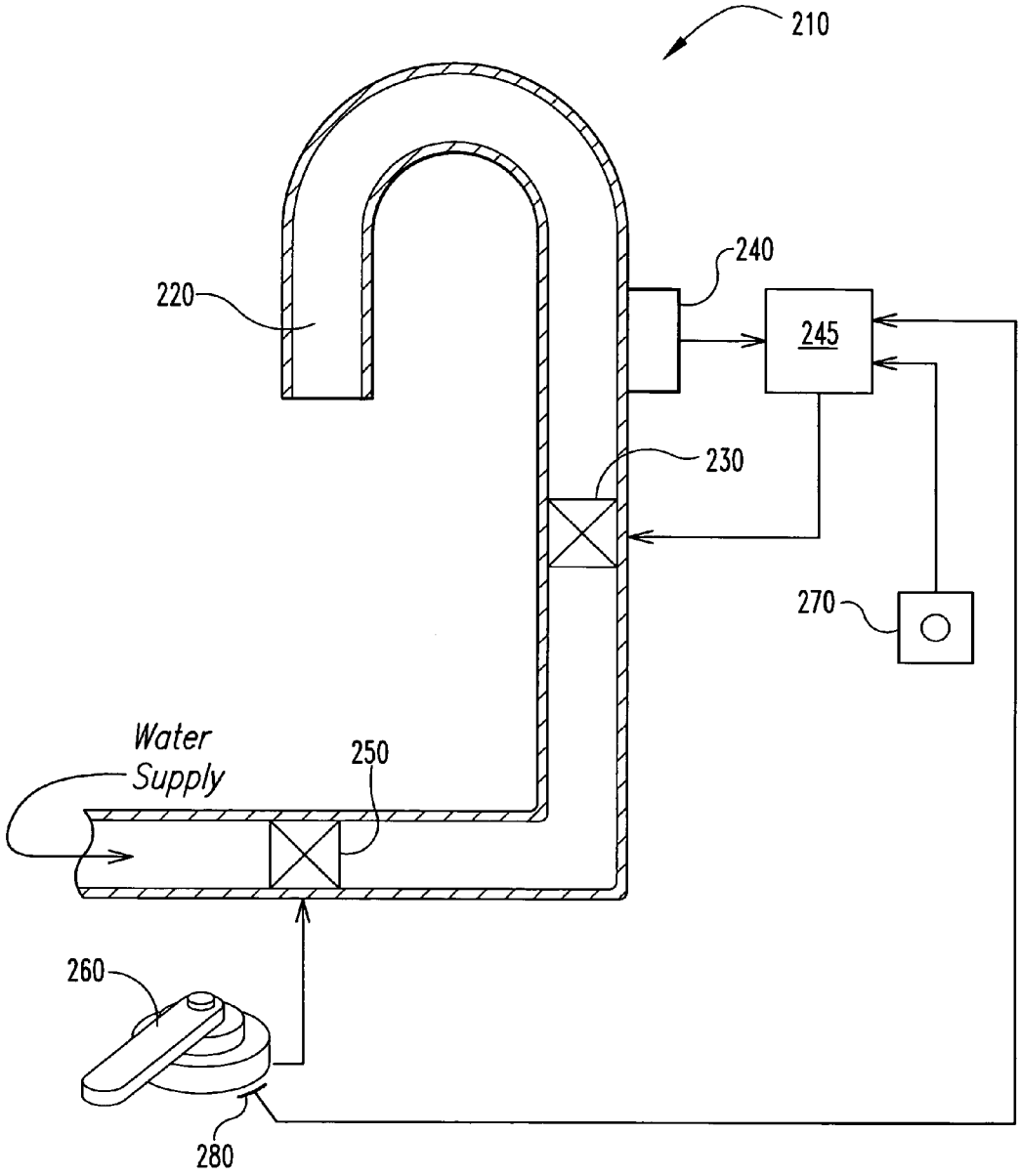
FIG. 2 is a schematic diagram of an automatic faucet according to one embodiment of the present invention.

For the purposes of promoting an understanding of the principles of the invention, reference will now be made to the preferred embodiment and specific language will be used to describe the same. It will nevertheless be understood that no limitation of the scope of the invention is thereby intended. Such alterations to and further modifications of the invention, and such further applications of the principles of the invention as described herein as would normally occur to one skilled in the art to which the invention pertains, are contemplated, and desired to be protected.

A preferred embodiment faucet 210 according to the present invention includes a touch sensor 240 in the spout 220 of the faucet, and another in the manual handle 260. The touch sensor 240 in the spout permits a user to turn water flow on and off merely by tapping the spout 220. In the preferred embodiment, the faucet 210 distinguishes between a tap on the spout 220 to turn the water flow on or off, and grasping the spout 220, for example to swing it from one basin of the sink to the other. Thus, the faucet 210 provides an easy and convenient way to turn the water off and on without having to adjust the water flow rate and temperature.

The touch sensor 280 in the handle can also be used for a tap control, which distinguishes between grasping the handle 260 to adjust the water flow rate or temperature, and merely tapping it to toggle water flow off or on. Preferably, though, the touch sensor 280 in the handle 260 is used to activate water flow automatically when the faucet is in a hands-free mode, as discussed in greater detail in the concurrently filed application entitled "Multi-Mode Hands-Free Automatic Faucet." Regardless, the touch sensor 280 in the handle 260 provides an additional source of input data for the faucet 210 which permits the faucet 210 to more accurately determine the intent of the user, thereby providing greater water savings while being intuitive and easy to use.

A preferred embodiment touch-control faucet according to the present invention employs a capacitive touch detector, as is known in the art. In the preferred embodiment, a QT118H, manufactured and sold by Quantum Research Group (www.qprox.com) is used. The QT118H is an electronic device that receives a signal from any suitable electrode and interprets it to determine when it has been touched by a user by observing the changes in the electrode's capacitance. The QT118H is advantageously used in the present invention because it can distinguish between changes that are caused by contact with a user and changes caused by, especially, drops of water that might contact the electrode.

Despite the advantageous features of the QT118H, use of the spout for the touch detector's electrode requires some measures to sufficiently isolate the spout from ground. For the touch detector in the spout, this is relatively easily accomplished, since the spout can be surrounded by a non-conductive covering upon which the touch detector's electrode can "float." However, with the manual handle the electrical isolation is more difficult to achieve. The handle and mechanical valve must be isolated from the rest of the sink, using rubber, plastic, or other such non-conductive components, as would occur to a person of ordinary skill in the art. However, because the handle is connected directly to the manual valve, which, in turn, contacts the water running through the faucet, this is not sufficient, by itself. (Use of a completely non-conductive manual valve is possible, but undesirable because of cost and mechanical reliability.)

It has been determined by the inventors that, in order to operate the QT118H with a sufficiently low power drain to make battery power a viable option, the resistance between the electrode and ground must be at least about 10 kΩ. Assuming essentially perfect isolation through the solid components of the faucet, this can be accomplished by separating the mechanical valve from the metallic water pipes through a long column of water. The required length of that column is a function of the conductivity of the water, which, it will be appreciated, varies enormously from geographic location to location. It has been determined by the inventors that even with water that is 6σ above the mean conductivity in the various water supplies throughout the United States, the required 10 kΩ of resistance is achieved when the water column is at least 18 inches long, with a circular cross-sectional diameter of ¼ inch. Thus, the preferred embodiment faucet according to the present invention includes at least 18 inches of non-conductive piping with a ¼ inch inner diameter that extends below the mechanical valve under the sink. The water pipe is connected to the faucet only at the end of that pipe. (It will be appreciated that in many embodiments two such pipes are requiredone for the hot water supply and one for the cold.) Preferably, these extensions are included in the form of flexible, non-conductive hoses.

In addition to isolating the manual valve from ground, it has also been determined by the inventors that performance of the capacitive touch sensors can be improved by tying the circuit ground to earth ground. Furthermore, for the sake of consistency the distal ends of the hoses should always be well grounded. This is inherently accomplished when the water pipes are copper (or another metal). However, when the pipes are plastic (or PVC), the ends of the hoses should be deliberately grounded.

Quantum Research Group also provides a variety of other suitable ICs that convert electrodes into touch sensors, including the rest of the QT110 series. It will be appreciated that these ICs have varying performance, including variations in the extent to which the electrode must be isolated from ground and the amount of power they draw. Thus, while the preferred embodiment employs the QT118H with an electrode separated from ground by 10 kΩ, other suitable configurations are possible, and will be apparent to those skilled in the art. Indeed, other capacitive touch detectors can be used as well. Suitable capacitive touch-detection systems are disclosed, for example, in U.S. Pat. No. 6,518,820 to Gremm, and U.S. Pat. No. 5,790,107 to Kasser, et al., which are hereby incorporated herein in their entireties. Electrode design is also discussed in detail in, for example, "Capacitive Sensors, Design and Applications," by Larry Baxter (IEEE Press).

While the preferred embodiment employs capacitive touch detection, in certain alternative embodiments other kinds of touch detecting are employed. Capacitive touch detection is preferable to, for example, the use of a strain gauge, because it provides a means to observe the length of contact, which can be used to infer whether the touch control was deliberately tapped with the intention of toggling water flow, or whether it was incidentally touched while the spout was repositioned. It will, however, be appreciated that other means of detecting physical contact can also be used, so long as they provide a means to detect both when the contact is initiated and when it is terminated.

In the preferred embodiment the touch sensor 240 is used with a logical control 245 to actuate an automatic valve 230 that is placed in series with the manual valve 250, so that the water flow can be toggled on and off without the need to reposition the manual valve 250. In this way, the water can be toggled on and off without altering the flow rate and the water temperature. The logical control 245 is preferably implemented with electrical or electronic circuitry, as is known in the art, that controls an electrically controlled valve 230 such as a magnetically latching solenoid valve.

The physical mechanism by which the water flow is toggled is not critical, but a magnetically latching pilot-operated solenoid valve is advantageously used, in part to limit power consumption. Regardless, this valve is preferably relatively slow-opening and -closing, in order to reduce pressure spikes, known as "water hammer," and undesirable splashing. On the other hand, the valve should not open or close so slowly as to be irritating to the user. It has been determined that a valve opening or closing period of at least 0.5 sufficiently suppresses water hammer and splashing.

In the preferred embodiment the touch control 240 in the spout 220 and the touch control 280 in the handle 260 articulate the electrically operable valve 230 via separate logical controls. (Although the logical controls are preferably distinct, they are preferably implemented with a single electric or electronic circuit 245.) In the preferred embodiment the touch control 240 in the spout 220 is controlled by a logical control that distinguishes between a grasping contract, such as occurs when a user touches the spout to reposition it, and a mere tap, which is presumed to be an instruction to toggle water flow.

FIG. 1 is a flowchart illustrating the logical control for the spout touch sensor in a preferred embodiment touch-control faucet according to the present invention, indicated generally at 100. The logical control initializes at start 101. At 103 it is determined whether the touch detector has detected contact. If no contact is detected, the process loops back to point 102, and step 103 is repeated until contact is detected. When, at step 103, contact is detected, at step 104 the length of time that the contact lasts is measured. It will be appreciated that this can be performed, for example, by another loop which waits for the contact to no longer be detected. Alternatively, it could be performed externally by the touch detector itself, and the length of contact can be input to the logical control 100 as an additional input.

At step 105 it is determined whether the contact time is below a predetermined threshold. Preferably, the predetermined threshold is approximately 0.25 second. When the spout is touched in order to reposition it, typically the contact lasts longer than about 0.25 second. On the other hand, when a user taps the spout to instruct the faucet to toggle water flow, the contact generally lasts less than about 0.25 second. Consequently, this threshold value causes the logical control 100 to distinguish between these two causes of contact with a user.

In addition to an upper bound on contact time, a lower bound may also be used. Such a lower bound can screen out erroneous stray signals from the capacitive sensor, such as might be caused by splashing water, for example. It has been determined by the inventors that using a lower bound on the order of about 0.05 second (50 milliseconds) eliminates most or all undesired cut-outs of the water flow. Thus, in the preferred embodiment, at step 105 it is determined whether the contact time is between about 50 and about 250 milliseconds.

If at step 105 it is determined that the contact time is not below the predetermined upper threshold (or is below the predetermined lower bound), the logical control returns to point 102, where the contact-detection loop is begun again. If it is determined at step 105 that the contact time is below the predetermined upper threshold (and is also above any predetermined upper bound), at step 106 the water valve is opened to initiate flow, at step 107 an auto-shutoff timer is started, and the logical control proceeds to point 108.

At step 109 it is determined whether the touch detector has detected contact. If so, at step 110 the length of contact is determined, as was done at step 104. Then, at step 111 it is determined whether the length of contact is greater than a predetermined threshold (not necessarily the same threshold as was used in step 105). If the length of contact is greater than the predetermined threshold, the logical control returns to point 108, whereupon the contact-detection loop begins again. If the length of the contact is less than the predetermined threshold, at step 112 the water valve is closed, and the logical control returns to point 102.

If, at step 109, contact with the touch-detector is not detected, then at step 114 it is determined whether the auto-shutoff timer has expired. If the auto-shutoff timer has not expired, then the logical control returns to point 108. If the auto-shutoff timer has expired, the logical control proceeds to step 112, where the valve is closed, and then returns to point 102.

In the preferred embodiment the faucet operates in at least two modes: a manual mode, wherein the electrically operable valve remains open, and a hands-free mode, wherein the electrically operable valve is toggled in response to signals from a proximity sensor. This is described in greater detail in the concurrently filed application entitled "Multi-Mode Hands-Free Automatic Faucet," U.S. application Ser. No. 10/755,581, which is hereby incorporated herein in its entirety. Thus, in the manual mode the faucet is controlled by the position of the handle like a conventional faucet, while in the hands-free mode, the flow is toggled on and off in response to the proximity sensor (while the flow temperature and rate are still controlled by the handle position, as normally). It will be appreciated that the logical control 100 can be used to permit touch-control of the faucet by tapping the spout in either of these two modes.

In certain embodiments, the logical control 100 is also used to interpret the signal from the touch sensor in the handle. However, preferably, while the faucet is in hands-free mode a separate logical control is used. Preferably, all other logical control of the faucet is overridden between the start of a touch detection by the touch sensor in the handle, and the opening of the electrically controlled valve, without respect to the duration of the touch. In this way, grasping the handle will always cause the water to flow. This makes it convenient for the user to adjust the water flow.

In certain alternative embodiments the logical control is adapted to respond to the duration of contact with the touch control to control the rate of flow, in addition to toggling the water flow on and off. In these embodiments the electrically operable valve is preferably not a magnetically latching valve. Instead, preferably, a valve is used that can be electrically controlled to be placed in range of positions, including an open position, a closed position, and a plurality of partially closed positions. It will be appreciated that the duration of contact with the touch control can be associated with any of a variety of instructions to the electrically operable valve. For example, in certain embodiments, contact of a duration below a given threshold (e.g., 50 ms) is ignored, contact of a duration within a relatively short window (e.g., 50–250 ms) is interpreted as an instruction to toggle water flow completely on or off, and contact of a greater duration is interpreted as a command to gradually decrease (or increase) flow rate as long as the contact is maintained.

It will be appreciated that this principle can be extended to touch control of the temperature of the water flow. In order to adjust the temperature, it will be appreciated that an electrically controlled valve must be included at a point in the water flow passageway upstream of the mixing point (typically at the mechanical valve). Preferably an additional electrically controlled valve is used, so that water flow can be toggled on and off with a single electrically operable valve (downstream of the mixing point). In certain alternative embodiments, a single additional electrically operable valve is included in the hot water line above the mixing point, and extended contact with the touch sensor is interpreted as a command to gradually alter the temperature of the water flow by gradually closing the hot water supply's electrically controlled valve. Using these principles, those skilled in the art will appreciate that a system can be developed to provide virtually any desired flow rate and temperature behavior.

It will be appreciated that the present invention can be used in conjunction with a hands-free control arrangement that interprets motion of objects, rather than merely their proximity, by employing a position-sensitive device ("PSD") as the proximity detector. A PSD is sensitive to motion of an object within its detection zone because it can sense the distance of an object from the sensor. This is discussed in greater detail in the concurrently filed application entitled "Control Arrangement for an Automatic Residential Faucet," U.S. application Ser. No. 10/755,582, which is hereby incorporated herein in its entirety.

While the invention has been illustrated and described in detail in the drawings and foregoing description, the description is to be considered as illustrative and not restrictive in character. Only the preferred embodiments, and such alternative embodiments deemed helpful in further illuminating the preferred embodiment, have been shown and described. It will be appreciated that changes and modifications to the forgoing can be made without departing from the scope of the following claims.

What is claimed is:

1. A faucet comprising:

a spout;

a passageway that conducts water flow through the spout;

a electrically operable valve disposed within the passageway;

a manual valve disposed within the passageway in series with the electrically operable valve;

a manual handle that controls the manual valve; and a capacitive touch control that is positioned in the spout, where the capacitive touch control toggles the electrically operable valve.

2. The faucet of claim 1, further comprising a logical control that toggles the electrically operable valve when the touch control is touched and released within a period of time shorter than a predetermined threshold, but does not toggle the electrically operable valve when the touch control is touched for a period longer than the predetermined threshold.

3. The faucet of claim 2, wherein the logical control toggles the electrically operable valve when the touch control is touched and released within a period of time between a predetermined lower bound and a predetermined upper threshold.

4. The faucet of claim 3, wherein the predetermined lower bound is about 50 ms, and the predetermined upper threshold is about 250 ms.

5. The faucet of claim 1, wherein the electrically operable valve is a magnetically latching valve.

6. The faucet of claim 1, further comprising a proximity sensor that is sensitive to motion of objects within a detection zone of the proximity sensor.

7. The faucet of claim 6, wherein the faucet has:

a manual mode, wherein the proximity sensor is inactive; and a hands-free mode, wherein water flow is toggled on and off in response to the proximity sensor.

8. The faucet of claim 1, further comprising a second capacitive touch control disposed within the manual handle that toggles the electrically operable valve.

9. A faucet comprising:

a spout;

a passageway that conducts water flow through the spout;

an electrically operable valve disposed within the passageway and having an opened position, in which water is free to flow through the passageway, and a closed position, in which the passageway is blocked;

a manual valve disposed within the passageway in series with the electrically operable valve;

a manual handle that controls the manual valve;

a first capacitive touch-control that is positioned in the spout and that generates a first output signal while the first capacitive touch-control is in contact with a user;

a second capacitive touch-control that is positioned in the manual handle and that generates a second output signal while the second capacitive touch-control is in contact with the user;

a logical control that receives the first and second output signals, and which toggles the electrically operable valve between the opened position and the closed position when either the first output signal or the second output signal begins and ends within a period of time between a predetermined lower bound and a predetermined upper bound; and a proximity sensor that is sensitive to motion of objects within a detection zone of the proximity sensor;

wherein the faucet has a manual mode, wherein the proximity sensor is inactive, and a hands-free mode, wherein the magnetically latching valve is toggled between the opened position and closed position in response to the proximity sensor, subject to being overridden by the output signal and logical control.

10. A faucet comprising:

a spout;

a passageway that conducts water flow through the spout;

an electrically operable valve disposed within the passageway;

a sensor operably connected to the electrically operable valve via a logical control, the logical control generating a control signal when the sensor senses an activation event having a duration less than a predetermined threshold; and wherein the electrically operable valve actuates in response to the control signal.

11. The faucet of claim 10, wherein the sensor is a touch sensor, and the activation event is contact with the touch sensor.

12. The faucet of claim 10, wherein the electrically operable valve is a magnetically latching valve.

13. The faucet of claim 10, further comprising a proximity sensor that produces a proximity sensor output signal corresponding to motion of one or more objects within a detection zone of the proximity sensor.

14. The faucet of claim 13, wherein the faucet has:

a manual mode, wherein the proximity sensor is inactive; and a hands-free mode, wherein water flow is toggled on and off in response to the proximity sensor output signal.

15. The faucet of claim 10, further comprising a second electrically operable valve having a plurality of partially closed positions, the second electrically operable valve being disposed in the passageway upstream of a mixing point, such that the second electrically operable valve affects the flow rate of only one of a hot or cold water supply.

16. The faucet of claim 15, wherein the logical control directs the second electrically operable valve to change among open, closed, and the plurality of partially closed positions in response to a duration of contact with the touch control.

17. A fluid flow control for a faucet having an electrically operable valve that is actuated in response to a control signal, the fluid flow control comprising:

a sensor that detects activation events;

a logical control in communication with the sensor, the logical control generating a control signal when the sensor observes an activation event occurring less than a predetermined number of times within a predetermined period, but which does not generate the control signal when the sensor observes an activation event occurring more than the predetermined number of times within a predetermined period.

18. A fluid flow control for a faucet having an electrically operable valve that is actuated in response to a control signal, the fluid control comprising:

a sensor that observes activation events; and a logical control operably connected to the sensor, the logical control generating a control signal when the sensor observes an activation event having a duration less than a predetermined threshold, but which does not generate the control signal when the sensor observes an activation event having a duration longer than the predetermined threshold.

19. The fluid flow control of claim 18, wherein the sensor is a proximity sensor that is sensitive to motion of objects within a detection zone of the proximity sensor.

20. The fluid flow control of claim 19, wherein the predetermined lower bound is about 50 ms and the predetermined upper threshold is about 250 ms.

21. The fluid flow control of claim 18, wherein the sensor is a capacitive touch sensor.

* * * * *